United States Patent [19]

Helversen et al.

[11] 4,074,441

[45] Feb. 21, 1978

[54] ROTARY THROUGH DRYER HAVING MULTIPLE VACUUM CHAMBERS AND ASSOCIATED HEATERS

[75] Inventors: Frederick D. Helversen, 1290 SW. Sixth Ave., Portland, Oreg. 97204; Morris R. Rivers, Vancouver, Wash.

[73] Assignee: Frederick D. Helversen, Portland, Oreg.

[21] Appl. No.: 664,992

[22] Filed: Mar. 8, 1976

[51] Int. Cl.[2] ..... D21F 5/18

[52] U.S. Cl. ..... 34/122; 34/115; 34/123; 34/131; 162/290; 162/315; 162/348; 162/359

[58] Field of Search ..... 34/115, 131, 134, 122, 34/123; 162/290, 315, 348, 359

[56] References Cited

U.S. PATENT DOCUMENTS

| | | | |
|---|---|---|---|
| 1,577,839 | 3/1929 | Moone | 34/115 X |
| 1,718,573 | 6/1929 | Millspaugh | 34/115 |
| 2,174,744 | 10/1939 | Hill | 34/115 |
| 3,098,371 | 7/1973 | Fleissner | 34/115 X |
| 3,432,936 | 3/1969 | Cole et al. | 34/6 |
| 3,447,247 | 6/1969 | Daane | 34/122 |
| 3,891,500 | 6/1975 | Kankaanpää | 34/122 |

FOREIGN PATENT DOCUMENTS

| | | | |
|---|---|---|---|
| 860,039 | 12/1952 | Germany | 34/115 |

*Primary Examiner*—William F. O'Dea

*Assistant Examiner*—Harold Joyce

*Attorney, Agent, or Firm*—Klarquist, Sparkman, Campbell, Leigh, Hall & Whinston

[57] ABSTRACT

A fiber sheet manufacturing apparatus, such as a paper machine, is described, including a rotary through dryer for drying the sheet material on the same foraminous conveyor where it is initially formed. The dryer is provided with a plurality of separate vacuum chambers circumferentially spaced within the foraminous dryer drum, which are each in registration with a different one of a plurality of sources of hot air outside of the drum. The hot air is transmitted through the sheet material and the conveyor into the vacuum chambers to dry the sheet material. Each of the vacuum chambers and the hot air sources is independently controlled to provide different temperatures and vacuum pressures for more efficient and versatile operation. The air is transmitted from the vacuum chambers out of the drum through their separate exhaust conduits extending through the end of the drum and spaced from the drum support bearings. The drum supports and associated bearings are in the form of external trunion rollers which engage the opposite ends of the drum side wall to provide space for the vacuum chambers and exhaust conduits within the drum. The exhaust of one vacuum chamber is connected to the heat source of the next vacuum chamber to use heated air of the preceding chamber for heat conservation.

13 Claims, 4 Drawing Figures

M
1A

ROTARY THROUGH DRYER HAVING MULTIPLE VACUUM CHAMBERS AND ASSOCIATED HEATERS

BACKGROUND OF THE INVENTION

The present invention relates generally to the drying of fibrous sheet materials by transmitting heated air through such sheet material with a rotary through dryer apparatus, and in particular to such an apparatus in which the through dryer drum contains a plurality of separate independently controlled vacuum chambers of different pressure circumferentially spaced about the axis of the drum and aligned with separate sources of hot air outside the drum which also may be independently controlled to provide different air temperatures.

The through dryer apparatus of the present invention is especially useful for the manufacture of porous paper products, such as tissue and towels. However, it is also possible that the through dryer apparatus of the present invention can be used for drying other porous fiber sheet material.

Through dryers have previously been used for drying paper, as shown in U.S. Pat. No. 3,432,936 of R. I. Cole et al. However, most conventional paper making machines employ one or more heated nonforaminous dryer drums called Yankee dryers, which dry the paper by contact with the surface of such drum. Yankee dryer drums are usually heated by supplying steam to the interior of such drum, which requires an extremely complex, expensive system for distributing steam to each dryer drum. In addition, such conventional drying systems are inefficient and for many types of paper require a large number of drying drums so that the dryer section of a typical paper machine extends over a long distance. The prior patented apparatus is inefficient and requires both a through dryer and a Yankee dryer as well as felted press rolls for removing the water from the paper after such paper is transferred to a second wire from the fourdrinier wire on which it is formed.

In contrast, the drying apparatus of the present invention employs the through dryer drum directly on the forming wire for drying the paper on the same wire where the paper is formed from pulp applied to such wire. The result is a more efficient drying apparatus which uses less energy to perform the drying operation. This extremely fast, efficient drying operation is achieved by providing a through dryer drum with a plurality of internal vacuum chambers having separate exhausts connected to different vacuum means for independently controlling the vacuum pressure and air flow in such chambers, and by employing separate sources of hot air of different independently controlled temperatures above such vacuum chambers. The term "air" as used in this application includes all types of gas suitable for drying purposes.

The above-mentioned patent discloses two exhaust conduits for two vacuum chambers having a common heated air source which extends through the hollow support shaft on which the drum is mounted, thereby limiting the size of the exhaust conduits, which reduces the maximum air flow as well as limiting the maximum air temperature to below that which will damage the shaft bearings. These problems are avoided in the present invention by using external trunnion rollers for mounting the through dryer drum to provide completely open space within the drum for the vacuum chambers. The trunnion rollers do not limit the size or position of the exhaust conduits for such chambers. As a result the exhaust conduits can be larger in diameter for greater air flow and extend through the end of the drum at positions spaced from the trunnion roller bearings to enable higher exhaust air temperatures.

Through dryers have been previously provided with separate external dryer hoods forming heating zones of different temperature spaced around the periphery of the dryer drum, as shown in U.S. Pat. No. 3,541,697 of Villalobos, U.S. Pat. No. 3,098,371 of Fleissner, and U.S. Pat. No. 3,891,500 of Kankaanpaa. However, in all cases these patents have employed a single vacuum chamber within the dryer drum and therefore cannot provide different independently controlled vacuum chambers beneath each of the hot air supply hoods, in the manner of the present invention. Furthermore, non of these through dryers are mounted on external trunnion rollers, as in this invention, to enable a plurality of vacuum chambers to be provided within the dryer drum with a plurality of separate exhaust conduits extending through the end of such drum which are independent from, and not limited in size or position by the drum support means.

Nonforaminous dryer drums, such as those used in Yankee dryers, and press rolls have been supported on trunnion rollers, as shown in U.S. Pat. No. 2,878,583 of Spooner, and U.S. Pat. No. 3,087,538 of Newman. However, unlike the present invention, this was not done to enable a plurality of vacuum chambers and their separate exhaust conduits to be mounted within the drum.

Previous attempts to use through dryers on fourdrinier wires without further drying on another wire, such as shown in U.S. Pat. No. 2,753,766 of Simpson, have been unsuccessful, among other reasons because the through dryers employed a single heating zone and a single vacuum chamber rather than a plurality of independently controlled vacuum chambers and independently controlled heating zones, in the manner of the present invention. As a result, such paper machines using through dryers on the forming wire have required additional drying after transferring the paper to another wire, as shown in U.S. Pat. No. 3,447,247 of Daane.

SUMMARY OF INVENTION

It is therefore one object of the present invention to provide an improved through drying apparatus of faster and more efficient drying operation for drying fibrous sheet material more completely and uniformly.

Another object of the invention is to provide such a through dryer apparatus having a plurality of independently controlled vacuum chambers and associated heating means in registration with such chambers on the opposite side of the sheet material being dried.

Another object of the invention is to provide such a rotary through dryer in which the dryer drum is mounted on trunnion rollers spaced from the separate exhaust conduits of the vacuum chambers within such drum so that such trunnion rollers do not interfere with the vacuum chambers and do not limit the size of the exhaust conduits to increase the maximum flow rate and temperature of the heated air flowing through such exhaust conduits.

An additional object of the present invention is to provide such a through dryer apparatus on the same foraminous conveyor on which the sheet material is formed, to decrease the size and complexity of the drying apparatus.

Still another object of the invention is to provide such a through dryer apparatus which is more versatile and can be used for drying different types of paper or other fibrous sheet material due to independent control of the temperature and the vacuum pressure for each heating means and vacuum chamber.

Still another object of the present invention is to provide such a through dryer in which the exhaust conduits of the vacuum chamber are connected to supply heated air to the sources of hot air over other vacuum chambers and thereby conserve energy for more economical operation.

BRIEF DESCRIPTION OF DRAWINGS

Other objects and advantages of the present invention will be apparent from the following detailed description of certain preferred embodiments thereof, and from the attached drawings of which.

DESCRIPTION OF PREFERRED EMBODIMENTS

Figures 1, 1A, 2, 3:
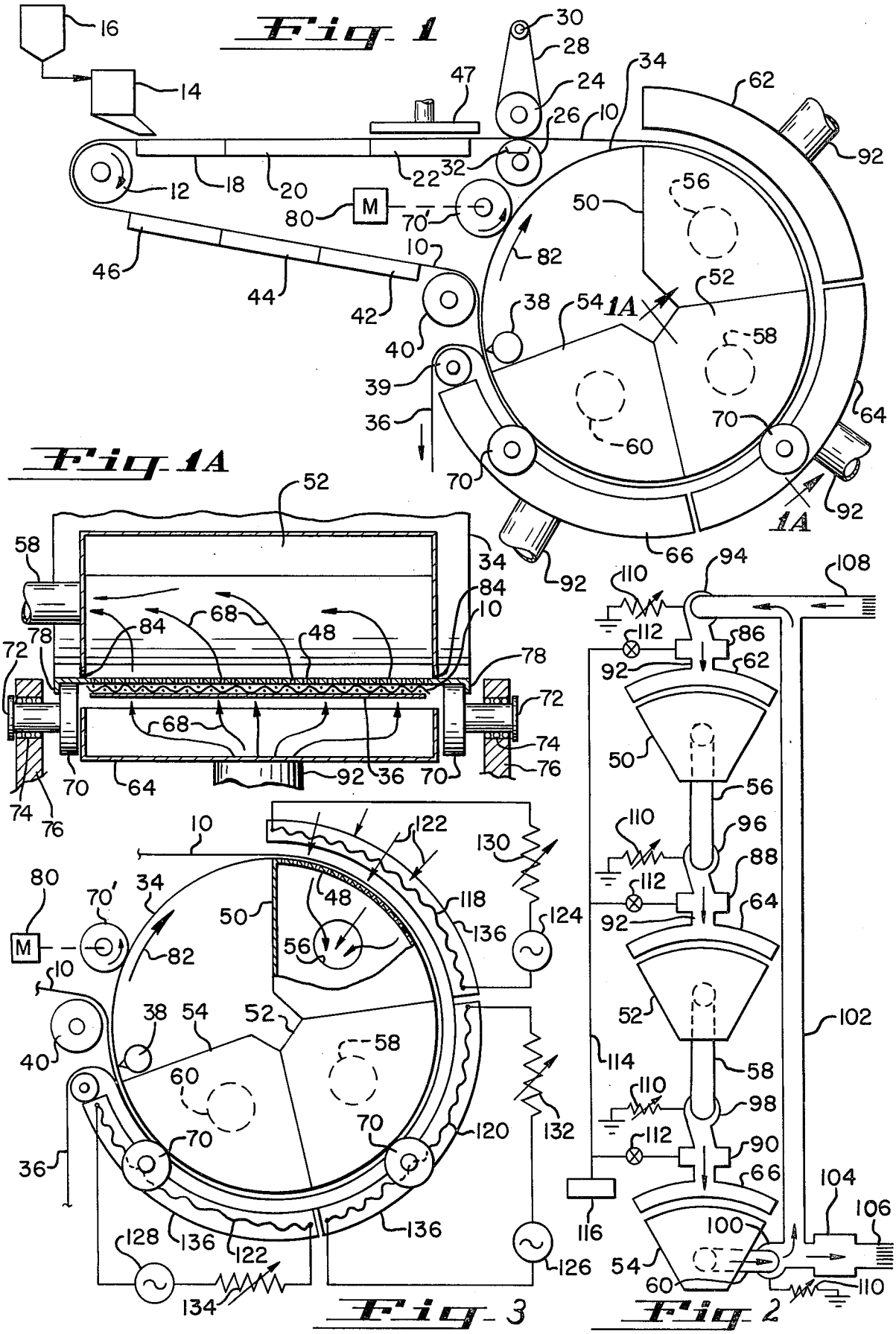
FIG. 1 is a schematic diagram of a paper making machine employing one embodiment of the through dryer of the present invention.
FIG. 1A is a section view taken along the lines 1A—1A of FIG. 1.
FIG. 2 is a schematic diagram of the air flow in the heating system used for the through dryer of FIG. 1.
FIG. 3 is a schematic diagram of another embodiment of the through dryer of the present invention which may be used in the paper making machine of FIG. 1, and which has parts broken away for clarity.

As shown in FIGS. 1 and 2, one embodiment of the drying apparatus of the present invention is a paper making machine including a foraminous conveyor belt 10, which may be a woven metal wire screen, sometimes called a "fourdrinier wire," or a similar conveyor belt made of woven synthetic plastic fabric or natural fabric, and is hereafter referred to as a "forming wire." The forming wire 10 extends from a breast roll 12 beneath the pulp outlet of a headbox 14 or other means for applying a liquid stock of paper pulp to such forming wire, such pulp being transmitted to the headbox from a pulp supply 16. The forming wire 10 and the pulp carried to the top side of such forming wire are transmitted across conventional dewatering devices positioned beneath the forming wire, such as a forming board 18, table rolls 20, and suction boxes 22, which are shown schematically, since their construction is well known. Other dewatering devices, such as foils, can also be employed but are not shown for purposes of simplicity.

As a result of the operation of the dewatering devices, the wood pulp is formed into a self-supporting paper sheet on the forming wire 10, such paper having a rather high moisture content at the output of the line of suction boxes 22. This wet paper sheet is carried by the wire 10 between a pair of press rolls 24 and 26 which contact the wire and paper to press moisture out of the paper. The upper press roll 24 may be provided with a felt 28 in the form of an endless belt which extends around a plurality of tension and guide rolls 30, only one of which is shown for simplicity. The felt 28 acts as a blotter to absorb moisture squeezed out of the paper by the press rolls. The lower press roll 26 may be a suction press roll provided with a vacuum box 32 within such roll so that it sucks more water from the paper through the porous side wall of such lower press roll in a conventional manner.

After passing through the press rolls 24 and 26, the forming wire 10 and moist paper sheet supported thereon pass over the outer surface of a rotary through dryer drum 34 made in accordance with the present invention. The through dryer drum 34 is located at the end of the upper reach of the forming wire 10 so that it takes the place of a conventional couch roll in the paper making machine and moves at the same speed as such wire. The dried paper sheet 36 is removed from the forming wire 10 after it travels around dryer drum 34, by means of a conventional air nozzle means 38, which blows the paper sheet off of the forming wire and causes it to move onto a take off roller 39. The forming wire 10 then continues over a guide roller 40 and passes over conventional wire cleaning devices, such as showers 42 and scraper blades 44, and over additional tension and guide rollers 46, back to the breast roll 12. Elements 42, 44, and 46 are shown schematically since they are all of conventional construction. A preheater 47, which may be in the form of a steam hood, can be provided in front of the press rolls to reduce the viscosity of the water in the paper so that such water is more easily removed by the press rolls and the through dryer 34.

The rotary through dryer 34 is in the form of a hollow cylindrical drum having a perforated side wall 48 around which the forming wire 10 and paper sheet 36 extend, as shown in FIG. 1A. Hot air or other gas is sucked through the paper sheet 36, forming wire 10, and the perforated drum wall 14, into a plurality of vacuum chambers 50, 52, and 54, fixedly supported within such dryer drum. The vacuum chambers 50, 52, and 54 are circumferentially spaced around the periphery of the dryer drum and are of substantially the same size. When three of such vacuum chambers are employed, the cross section of each vacuum chamber may extend through an arc of approximately 80° and such chamber extends longitudinally along substantially the entire length of the perforated side wall 48 of the drum. The vacuum chambers 50, 52 and 54 are each provided with a separate exhaust conduit 56, 58, and 60 respectively, which extends through one end of the dryer drum 34 into communication with an exhaust fan or other vacuum source. The three vacuum sources connected to the exhaust conduits 56, 58, and 60 are independently controlled to enable different vacuum pressures and air flow rates to be provided in each of the vacuum chambers 50, 52, and 54. This enables the vacuum pressure and flow rates to be adjusted for making different types of paper or other fibrous sheet material to insure optimum drying conditions.

Three separate independently controlled heat sources, such as hot air supply hoods 62, 64, and 66 are each provided on opposite sides of the wire 10 from a different one of the vacuum chambers 50, 52, and 54. The hoods supply hot air or other gas through the paper 36, forming wire 10, and perforated drum wall 48 into the vacuum chambers, as shown by the air flow arrows 68 in FIG. 1A. Each of the hoods 62, 64, and 66 is in registration with a different one of the vacuum chambers 50, 52, and 54 and is connected to a different one of three sources of hot air whose temperatures may be independently controlled. Thus, the hot air passing through the paper sheet may be of different temperatures in each of the three heating zones provided by hoods 62, 64, and 66, for more versatile operation to enable drying at different types of paper and other fibrous sheet materials under optimum drying conditions.

In order to provide sufficient room within the dryer drum 34 for the vacuum chambers and their three separate exhaust conduits extending through the end thereof, such dryer drum is mounted on three pairs of trunnion rollers 70 which engage the outer surface of unperforated portions of the drum side wall 48 at the opposite ends of the drum, as shown in FIG. 1A. The trunnion rollers 70 have shafts 72 mounted within bearings 74 attached to support brackets 76. The dryer drum 34 is provided with two outwardly projecting flanges 78 at the opposite ends of such drum, to prevent the drum from sliding off the pairs of trunnion rollers. One pair of trunnion rollers 70' which may be connected together on a common shaft, are driven by coupling such shaft to an electric motor 80 to cause the dryer drum to rotate in a clockwise direction, as shown by arrow 82. In order to provide more positive drive, the outer surfaces of the motor driven trunnion rollers 70' may be provided with helical gear teeth which mesh with corresponding gear teeth provided on the surface of the dryer drum 34. It may be desirable to position the upper driving trunnion roller 70' in contact with the inner surface of the dryer drum so that the gear teeth on such drum are not in position to engage the bottom two pairs of trunnion rollers supporting such drum. It should be noted that the outer edges 84 of the fixed vacuum chambers 50, 52 and 54 are closely spaced from the inner surface of the dryer drum to prevent air leakage. Also, it is possible that a high temperature sealing material could be used on such edges to form bearing surfaces engaging the rotating drum. However, this is not necessary at most operating vacuum pressures.

As shown in FIGS. 1 and 1A, the exhaust conduits 56, 58, and 60 of the vacuum chambers may be of extremely large diameter to increase the maximum flow rate of air through such chambers. Also, such exhaust conduits are radially spaced from the trunnion rollers 70 and their associated bearings 74, so that the maximum temperature of the air transmitted through the vacuum chambers may be increased. In this regard, it should be noted that some heat will be conducted through the rollers 70 and their shafts 72 if they are made of metal, but the bearings 74 will still be at a lower temperature than the exhaust conduit 58 through which the heated air flows.

As shown in FIG. 2, each of the hot air supply hoods 62, 64 and 66 is connected to a different gas fired heater 86, 88, and 90 respectively, through a connecting conduit 92. It should be understood that other types of heaters could be employed, including electrical or oil heaters. Air is transmitted through the heaters 86, 88, and 90 from the output of fans 94, 96, and 98, respectively. Fans 96 and 98 also function as exhaust fans having their inputs connected to exhaust conduits 56 and 58 of the next preceding vacuum chambers 50 and 52, to create vacuum pressures within such chambers. In addition, a third exhaust fan 100 is connected to exhaust conduit 60 to create a vacuum pressure within chamber 54. The output of fan 100 is connected through conduit 102 to the input of fan 94, so that the heated air exhausted from vacuum chamber 54 is also supplied through the heater 86 to the hood 62 overlying the first vacuum chamber 50.

Some of the heated air is transmitted through a filter 104 and an exhaust outlet 106 to the atmosphere in order to remove moisture and pollutants from such air. To make up for this lost exhaust air, a fresh air inlet 108 is connected to the first fan 94.

Each of the fans 94, 96, 98, and 100 is provided with a control 110 for changing the speed of such fans in order to independently adjust the air flow rate and vacuum pressure within vacuum chambers 50, 52, and 54. The fan controls are shown schematically as an electrical rheostat but can be any other suitable type of control. Similarly, each of the heaters 86, 88, and 90 is provided with a separate temperature control 112 which is shown as a valve in the gas line 114 connecting such heaters to the gas source 116, which would be in most cases the main gas line of a commercial gas company. Thus, it can be seen that the temperature of the heated air transmitted through each of the hoods 62, 64, and 66 can be independently controlled nd the vacuum pressures and flow rate of each of the vacuum chambers 50, 52, and 54 can also be independently controlled. Furthermore, by utilizing the heated air exhausted from one vacuum chamber to supply air to the heater for the hood covering another vacuum chamber, the system of FIG. 2 achieves considerable conservation of energy which reduces the expense of operation of the drying apparatus of the present invention.

Another embodiment of the dryer apparatus of the present invention is shown in FIG. 3, which is similar to that of FIG. 1, except that it uses different means for supplying the heated air transmitted through the paper into the vacuum chambers. Thus, three separate electrical resistance heating elements 118, 120, and 122 are positioned on the opposite side of the forming wire 10 from vacuum chambers 50, 52, and 54 respectively. These heating elements heat ambient air, shown by arrows 122, as it is drawn through such heating elements and the wire into the vacuum chambers by the fans or other vacuum sources connected to the exhaust conduits 56, 58, and 60 of such vacuum chambers. The electrical heating elements 118, 120, and 122 are connected to separate sources of electrical heating current 124, 126, and 128 respectively. Variable resistors 130, 132, and 134, respectively, are connected in series between the heating elements 118, 120, 122, and their respective current sources 124, 126, and 128. Resistors 130, 132, and 134 independently control the temperature of the heated air transmitted through the heating zones over vacuum chambers 50, 52, and 54, by varying the current transmitted through the electrical heating elements. Thus, variable resistors 130, 132, and 134 perform a similar function to that of the gas valve 112 in the embodiment of FIG. 2. Each of the electrical heating elements is mounted on a porous support member 136 made of a refractory insulating material such as a suitable ceramic. It should be noted that infrared heaters or ultra high frequency heaters could be employed in place of the electrical resistance heating elements shown in FIG. 3.

It will be obvious to those having ordinary skill in the art that many changes may be made in the abovedescribed preferred embodiments of the present invention without departing from the spirit of the invention. Therefore, the scope of the invention should only be determined by the following claims.

We claim:

1. A sheet drying apparatus comprising:

a movable endless foraminous conveyor for carrying fibrous sheet material to be dried;

forming means for forming said sheet material on said conveyor from liquid stodz deposited on said conveyor;

a rotary dryer drum having foraminous side wall about which said conveyor extends for drying the sheet material on the same conveyor on which it is formed;

support means including bearings for supporting the dryer drum for rotation;

a plurality of separate vacuum chambers fixedly mounted within the dryer drum for drawing moisture from the sheet material into said chambers through said side wall of said drum, each chamber having a separate fixed exhaust conduit which extends out through an end of the dryer drum at a position radially spaced from the support means;

vacuum means connected to the exhaust conduits of said vacuum chambers for independently controlling the vacuum pressures in said chambers;

heating means outside of the dryer drum for causing heated gas to flow through the sheet material and said conveyor into said vacuum chambers for heating the sheet material in a plurality of heating zones of different temperatures positioned over and in registration with the vacuum chambers; and removal means for removing the sheet material from said conveyor after it is dryed.

2. A drying apparatus in accordance with claim 1 in which the support means includes trunnion rollers engaging the side wall of the dryer drum and spaced from the foraminous conveyor and sheet material.

3. A drying apparatus in accordance with claim 1 in which the trunnion rollers engage the outer surface of said side wall at the opposite ends of the dryer drum.

4. A drying apparatus in accordance with claim 3 in which at least one of the trunnion rollers are driven by a motor to rotate the dryer drum which drives the conveyor.

5. A drying apparatus in accordance with claim 1 in which the heating means supplies heated air which flows through the sheet material and the foraminous conveyor into the vacuum chambers.

6. A drying apparatus in accordance with claim 1 in which the heating means includes a plurality of separate hoods containing the heating zones, and which supplies heated air flowing through the sheet material and the foraminous conveyor into the vacuum chambers.

7. A drying apparatus in accordance with claim 6 in which the exhaust outlets of the vacuum chambers are each coupled to one of the hoods positioned over a different vacuum chamber.

8. A drying apparatus in accordance with claim 1 which also includes press roll means between said forming means and the dryer drum, for removing moisture from the sheet material by pressing before it reaches the dryer drum.

9. A drying apparatus in accordance with claim 1 in which the sheet material is paper.

10. A drying apparatus in accordance with claim 1 in which the first vacuum chamber reached by the sheet material is of substantially the same size as the next successive vacuum chamber.

11. A drying apparatus in accordance with claim 1 in which there are at least three vacuum chambers spaced circumferentially around the axis of the dryer drum and extending longitudinally of said drum, each of said vacuum chambers being of a different vacuum pressure.

12. A drying apparatus in accordance with claim 11 in which all of the vacuum chambers are of substantially the same size.

13. A drying apparatus in accordance with claim 1 in which the rotary dryer dries the sheet material sufficiently on the forming conveyor so that no further through drying with heated gas is necessary after said sheet material is removed from said conveyor.

* * * * *

UNITED STATES PATENT OFFICE

CERTIFICATE OF CORRECTION

Patent No. 4,074,441 Dated February 21, 1978

Inventor(s) FREDERICK D. HELVERSEN ET AL

It is certified that error appears in the above-identified patent and that said Letters Patent are hereby corrected as shown below:

Column 2, line 17, "non" should be --none--.

Column 5, line 2, "at" should be --of--.

Column 6, line 17, "nd" should be --and--.

Column 6, line 60, "abovede-" should be -- above-de- --.

Column 7, claim 1, line 2, "stodz" should be --stock--.

Column 7, claim 1, line 4, before "foraminous" insert --a--.

Signed and Sealed this

Thirtieth Day of May 1978

[SEAL]

Attest:

RUTH C. MASON
Attesting Officer

LUTRELLE F. PARKER
Acting Commissioner of Patents and Trademarks